US011320774B2

(12) United States Patent
Kim

(10) Patent No.: US 11,320,774 B2
(45) Date of Patent: May 3, 2022

(54) ESTIMATION OF TONER REMAINING RATE

(71) Applicant: Hewlett-Packard Development Company, L.P., Spring, TX (US)

(72) Inventor: Jincheol Kim, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/260,683

(22) PCT Filed: Jul. 19, 2019

(86) PCT No.: PCT/US2019/042639
§ 371 (c)(1),
(2) Date: Jan. 15, 2021

(87) PCT Pub. No.: WO2020/146010
PCT Pub. Date: Jul. 16, 2020

(65) Prior Publication Data

US 2021/0325807 A1 Oct. 21, 2021

(30) Foreign Application Priority Data

Jan. 11, 2019 (KR) ..... 10-2019-0003756

(51) Int. Cl.
*G03G 15/08* (2006.01)
*G03G 15/00* (2006.01)

(52) U.S. Cl.
CPC ..... *G03G 15/556* (2013.01); *G03G 15/0856* (2013.01); *G03G 15/0877* (2013.01); *G03G 15/0875* (2013.01)

(58) Field of Classification Search
CPC ..... G03G 15/08; G03G 15/0856; G03G 15/0877; G03G 15/556; G03G 15/0875
See application file for complete search history.

(56) References Cited

U.S. PATENT DOCUMENTS 8,238,767 B2 * 8/2012 Kawarazuka ..... B41J 2/17566 399/27
8,666,264 B2 3/2014 Shimazu et al.
(Continued)

FOREIGN PATENT DOCUMENTS

EP 1 586 956 B1 10/2008
EP 2 333 616 A1 6/2011
(Continued)

*Primary Examiner* — Hoang X Ngo
(74) *Attorney, Agent, or Firm* — Jefferson IP Law, LLP

(57) ABSTRACT

An image forming apparatus includes a body on which a development cartridge is mountable to form a toner image by supplying toner in the development cartridge to an electrostatic latent image formed, a communicating portion provided on an outer surface of the body to be coupled with a toner refill cartridge to form a connection with the development cartridge to perform a toner refill of the toner in the development cartridge through the connection with the development cartridge, a sensor to detect a remaining toner amount remaining in the development cartridge, and a controller to estimate, based on the sensor detecting the remaining toner amount, an estimated toner remaining rate of the development cartridge, which is an estimated rate of the toner remaining in the development cartridge based on toner consumption, according to the toner refill.

15 Claims, 8 Drawing Sheets

(56) References Cited

U.S. PATENT DOCUMENTS

| | | | |
|---|---|---|---|
| 2004/0218936 | A1 | 11/2004 | Dougherty et al. |
| 2016/0378020 | A1 | 12/2016 | Asaka |

FOREIGN PATENT DOCUMENTS

| | | | |
|---|---|---|---|
| JP | 8-320613 | A | 12/1996 |
| JP | 2002-278249 | A | 9/2002 |
| JP | 2004-354666 | A | 12/2004 |
| JP | 2008-139485 | A | 6/2008 |
| JP | 2013-117558 | A | 6/2013 |
| JP | 2016-114921 | A | 6/2016 |

* cited by examiner

FIG. 5

$$\text{ESTIMATED TONER REMAINING RATE} = 1 - \frac{(\text{CONSUMPTION AMOUNT} - \text{CONSUMPTION AMOUNT ACCUMULATED AT REFILL TIME})}{\text{TARGET CONSUMPTION AMOUNT}} - \text{CORRECTION VALUE} \quad \cdots\cdots ①$$

$$\text{CORRECTION VALUE} = \text{FREE CAPACITY RATIO AFTER REFILL} - \text{ADJUSTED TONER REMAINING RATE BASED ON TONER REMAINING RATE CALCULATED IMMEDIATELY BEFORE REFILL} \quad \cdots\cdots ②$$

$$\text{FREE CAPACITY RATIO AFTER REFILL} = 1 - \text{FILLING RATIO AFTER REFILL} \quad \cdots\cdots ③$$

$$\text{ESTIMATED TONER REMAINING RATE} = \text{FILLING RATIO AFTER REFILL} + \text{ADJUSTED TONER REMAINING RATE} - \frac{(\text{CONSUMPTION AMOUNT} - \text{CONSUMPTION AMOUNT ACCUMULATED AT REFILL TIME})}{\text{TARGET CONSUMPTION AMOUNT}} \quad \cdots\cdots ④$$

FIG. 8

AFTER TONER EXHAUSTION Case 1 (Calculated R.R = Real R.R)

| ACC CON | ADJ R.R | Calculated | | Real | | |
|---|---|---|---|---|---|---|
| | | CON | R.R | Wt | R.R | |
| 0 | 50% | 0 | 100% | 100.0 | 100% | |
| 0 | 50% | 250 | 95% | 95.0 | 95% | |
| 0 | 50% | 500 | 90% | 90.0 | 90% | |
| 0 | 50% | 750 | 85% | 85.0 | 85% | |
| 0 | 50% | 1000 | 80% | 80.0 | 80% | |
| 0 | 50% | 1250 | 75% | 75.0 | 75% | |
| 0 | 50% | 1500 | 70% | 70.0 | 70% | |
| 0 | 50% | 1750 | 65% | 65.0 | 65% | |
| 0 | 50% | 2000 | 60% | 60.0 | 60% | |
| 0 | 50% | 2250 | 55% | 55.0 | 55% | |
| 0 | 50% | 2500 | 50% | 50.0 | 50% | |
| 0 | 50% | 2750 | 45% | 45.0 | 45% | |
| 0 | 50% | 3000 | 40% | 40.0 | 40% | |
| 0 | 50% | 3250 | 35% | 35.0 | 35% | |
| 0 | 50% | 3500 | 30% | 30.0 | 30% | |
| 0 | 50% | 3750 | 25% | 25.0 | 25% | |
| 0 | 50% | 4000 | 20% | 20.0 | 20% | |
| 0 | 50% | 4250 | 15% | 15.0 | 15% | |
| 0 | 50% | 4500 | 10% | 10.0 | 10% | |
| 0 | 50% | 4750 | 5% | 5.0 | 5% | |
| 0 | 50% | 5000 | 0% | 0.0 | 0% | EOL |
| 5000 | 0% | 5000 | 50% | 50.0 | 50% | |
| 5000 | 0% | 5250 | 45% | 45.0 | 45% | |
| 5000 | 0% | 5500 | 40% | 40.0 | 40% | |
| 5000 | 0% | 5750 | 35% | 35.0 | 35% | |
| 5000 | 0% | 6000 | 30% | 30.0 | 30% | |
| 5000 | 0% | 6250 | 25% | 25.0 | 25% | |

AFTER TONER EXHAUSTION Case 2 (Calculated R.R > Real R.R)

| ACC CON | ADJ R.R | Calculated | | Real | | |
|---|---|---|---|---|---|---|
| | | CON | R.R | Wt | R.R | |
| 0 | 50% | 0 | 100% | 100.0 | 100% | |
| 0 | 50% | 250 | 95% | 94.4 | 94% | |
| 0 | 50% | 500 | 90% | 88.9 | 89% | |
| 0 | 50% | 750 | 85% | 83.3 | 83% | |
| 0 | 50% | 1000 | 80% | 77.8 | 78% | |
| 0 | 50% | 1250 | 75% | 72.2 | 72% | |
| 0 | 50% | 1500 | 70% | 66.7 | 67% | |
| 0 | 50% | 1750 | 65% | 61.1 | 61% | |
| 0 | 50% | 2000 | 60% | 55.6 | 56% | |
| 0 | 50% | 2250 | 55% | 50.0 | 50% | |
| 0 | 50% | 2500 | 50% | 44.4 | 44% | |
| 0 | 50% | 2750 | 45% | 38.9 | 39% | |
| 0 | 50% | 3000 | 40% | 33.3 | 33% | |
| 0 | 50% | 3250 | 35% | 27.8 | 28% | |
| 0 | 50% | 3500 | 30% | 22.2 | 22% | |
| 0 | 50% | 3750 | 25% | 16.7 | 17% | |
| 0 | 50% | 4000 | 20% | 11.1 | 11% | |
| 0 | 50% | 4250 | 15% | 5.6 | 6% | |
| 0 | 50% | 4500 | 10% | 0.0 | 0% | EOL |
| 4500 | 0% | 4500 | 50% | 50.0 | 50% | |
| 4500 | 0% | 4750 | 45% | 44.4 | 44% | |
| 4500 | 0% | 5000 | 40% | 38.9 | 39% | |
| 4500 | 0% | 5250 | 35% | 33.3 | 33% | |
| 4500 | 0% | 5500 | 30% | 27.8 | 28% | |
| 4500 | 0% | 5750 | 25% | 22.2 | 22% | |
| 4500 | 0% | 6000 | 20% | 16.7 | 17% | |
| 4500 | 0% | 6250 | 15% | 11.1 | 11% | |

AFTER TONER EXHAUSTION Case 3 (Calculated R.R < Real R.R)

| ACC CON | ADJ R.R | Calculated | | Real | | |
|---|---|---|---|---|---|---|
| | | CON | R.R | Wt | R.R | |
| 0 | 50% | 0 | 100% | 100.0 | 100% | |
| 0 | 50% | 250 | 95% | 95.5 | 95% | |
| 0 | 50% | 500 | 90% | 90.9 | 91% | |
| 0 | 50% | 750 | 85% | 86.4 | 86% | |
| 0 | 50% | 1000 | 80% | 81.8 | 82% | |
| 0 | 50% | 1250 | 75% | 77.3 | 77% | |
| 0 | 50% | 1500 | 70% | 72.7 | 73% | |
| 0 | 50% | 1750 | 65% | 68.2 | 68% | |
| 0 | 50% | 2000 | 60% | 63.6 | 64% | |
| 0 | 50% | 2250 | 55% | 59.1 | 59% | |
| 0 | 50% | 2500 | 50% | 54.5 | 55% | |
| 0 | 50% | 2750 | 45% | 50.0 | 50% | |
| 0 | 50% | 3000 | 40% | 45.5 | 45% | |
| 0 | 50% | 3250 | 35% | 40.9 | 41% | |
| 0 | 50% | 3500 | 30% | 36.4 | 36% | |
| 0 | 50% | 3750 | 25% | 31.8 | 32% | |
| 0 | 50% | 4000 | 20% | 27.3 | 27% | |
| 0 | 50% | 4250 | 15% | 22.7 | 23% | |
| 0 | 50% | 4500 | 10% | 18.2 | 18% | |
| 0 | 50% | 4750 | 5% | 13.6 | 14% | |
| 0 | 50% | 5000 | 0% | 9.1 | 9% | |
| 0 | 50% | 5250 | −5% | 4.5 | 5% | |
| 0 | 50% | 5500 | −10% | 0.0 | 0% | EOL |
| 5500 | 0% | 5500 | 50% | 50.0 | 50% | |
| 5500 | 0% | 5750 | 45% | 45.5 | 45% | |
| 5500 | 0% | 6000 | 40% | 40.9 | 41% | |
| 5500 | 0% | 6250 | 35% | 36.4 | 36% | |

FIG. 9

BEFORE TONER EXHAUSTION Case 1
(Calculated R.R = Real R.R)

| ACC CON | ADJ R.R | Calculated | | Real | |
|---|---|---|---|---|---|
| | | CON | R.R | Wt | R.R |
| 0 | 50% | 0 | 100% | 100.0 | 100% |
| 0 | 50% | 250 | 95% | 95.0 | 95% |
| 0 | 50% | 500 | 90% | 90.0 | 90% |
| 0 | 50% | 750 | 85% | 85.0 | 85% |
| 0 | 50% | 1000 | 80% | 80.0 | 80% |
| 0 | 50% | 1250 | 75% | 75.0 | 75% |
| 0 | 50% | 1500 | 70% | 70.0 | 70% |
| 0 | 50% | 1750 | 65% | 65.0 | 65% |
| 0 | 50% | 2000 | 60% | 60.0 | 60% |
| 0 | 50% | 2250 | 55% | 55.0 | 55% |
| 0 | 50% | 2500 | 50% | 50.0 | 50% |
| 0 | 50% | 2750 | 45% | 45.0 | 45% |
| 0 | 50% | 3000 | 40% | 40.0 | 40% |
| 0 | 50% | 3250 | 35% | 35.0 | 35% |
| 0 | 50% | 3500 | 30% | 30.0 | 30% |
| 0 | 50% | 3750 | 25% | 25.0 | 25% |
| 0 | 50% | 4000 | 20% | 20.0 | 20% |
| 4000 | 20% | 4000 | 70% | 60.0 | 60% |
| 4000 | 20% | 4250 | 65% | 55.0 | 55% |
| 4000 | 20% | 4500 | 60% | 50.0 | 50% |
| 4000 | 20% | 4750 | 55% | 45.0 | 45% |
| 4000 | 20% | 5000 | 50% | 40.0 | 40% |
| 4000 | 20% | 5250 | 45% | 35.0 | 35% |
| 4000 | 20% | 5500 | 40% | 30.0 | 30% |
| 4000 | 20% | 5750 | 35% | 25.0 | 25% |
| 4000 | 20% | 6000 | 30% | 20.0 | 20% |
| 4000 | 20% | 6250 | 25% | 15.0 | 15% |

BEFORE TONER EXHAUSTION Case 2
(Calculated R.R > Real R.R)

| ACC CON | ADJ R.R | Calculated | | Real | |
|---|---|---|---|---|---|
| | | CON | R.R | Wt | R.R |
| 0 | 50% | 0 | 100% | 100.0 | 100% |
| 0 | 50% | 250 | 95% | 94.4 | 94% |
| 0 | 50% | 500 | 90% | 88.9 | 89% |
| 0 | 50% | 750 | 85% | 83.3 | 83% |
| 0 | 50% | 1000 | 80% | 77.8 | 78% |
| 0 | 50% | 1250 | 75% | 72.2 | 72% |
| 0 | 50% | 1500 | 70% | 66.7 | 67% |
| 0 | 50% | 1750 | 65% | 61.1 | 61% |
| 0 | 50% | 2000 | 60% | 55.6 | 56% |
| 0 | 50% | 2250 | 55% | 50.0 | 50% |
| 0 | 50% | 2500 | 50% | 44.4 | 44% |
| 0 | 50% | 2750 | 45% | 38.9 | 39% |
| 0 | 50% | 3000 | 40% | 33.3 | 33% |
| 0 | 50% | 3250 | 35% | 27.8 | 28% |
| 0 | 50% | 3500 | 30% | 22.2 | 22% |
| 0 | 50% | 3750 | 25% | 16.7 | 17% |
| 0 | 50% | 4000 | 20% | 11.1 | 11% |
| 4000 | 20% | 4000 | 70% | 61.1 | 61% |
| 4000 | 20% | 4250 | 65% | 55.6 | 56% |
| 4000 | 20% | 4500 | 60% | 50.0 | 50% |
| 4000 | 20% | 4750 | 55% | 44.4 | 44% |
| 4000 | 20% | 5000 | 50% | 38.9 | 39% |
| 4000 | 20% | 5250 | 45% | 33.3 | 33% |
| 4000 | 20% | 5500 | 40% | 27.8 | 28% |
| 4000 | 20% | 5750 | 35% | 22.2 | 22% |
| 4000 | 20% | 6000 | 30% | 16.7 | 17% |
| 4000 | 20% | 6250 | 25% | 11.1 | 11% |

BEFORE TONER EXHAUSTION Case 3
(Calculated R.R < Real R.R)

| ACC CON | ADJ R.R | Calculated | | Real | |
|---|---|---|---|---|---|
| | | CON | R.R | Wt | R.R |
| 0 | 50% | 0 | 100% | 100.0 | 100% |
| 0 | 50% | 250 | 95% | 95.8 | 96% |
| 0 | 50% | 500 | 90% | 91.7 | 92% |
| 0 | 50% | 750 | 85% | 87.5 | 88% |
| 0 | 50% | 1000 | 80% | 83.3 | 83% |
| 0 | 50% | 1250 | 75% | 79.2 | 79% |
| 0 | 50% | 1500 | 70% | 75.0 | 75% |
| 0 | 50% | 1750 | 65% | 70.8 | 71% |
| 0 | 50% | 2000 | 60% | 66.7 | 67% |
| 0 | 50% | 2250 | 55% | 62.5 | 63% |
| 0 | 50% | 2500 | 50% | 58.3 | 58% |
| 0 | 50% | 2750 | 45% | 54.2 | 54% |
| 0 | 50% | 3000 | 40% | 50.0 | 50% |
| 0 | 50% | 3250 | 35% | 45.8 | 46% |
| 0 | 50% | 3500 | 30% | 41.7 | 42% |
| 0 | 50% | 3750 | 25% | 37.5 | 38% |
| 0 | 50% | 4000 | 20% | 33.3 | 33% |
| 0 | 50% | 4250 | 15% | 29.2 | 29% |
| 0 | 50% | 4500 | 10% | 25.0 | 25% |
| 0 | 50% | 4750 | 5% | 20.8 | 21% |
| 0 | 50% | 5000 | 0% | 16.7 | 17% |
| 0 | 50% | 5250 | −5% | 12.5 | 13% |
| 0 | 50% | 5500 | −10% | 8.3 | 8% |
| 5500 | 0% | 5500 | 50% | 58.3 | 58% |
| 5500 | 0% | 5750 | 45% | 54.2 | 54% |
| 5500 | 0% | 6000 | 40% | 50.0 | 50% |
| 5500 | 0% | 6250 | 35% | 45.8 | 46% |

ESTIMATION OF TONER REMAINING RATE

BACKGROUND

An image forming apparatus using an electrophotographic method forms a visible toner image on a photoconductor by supplying toner to an electrostatic latent image formed on the photoconductor, transfers the toner image to a print medium directly or through an intermediate transfer medium, and then fuses the transferred toner image onto the print medium.

A development cartridge accommodates the toner and supplies the toner to the electrostatic latent image formed on the photoconductor to form the visible toner image. When the toner accommodated in the development cartridge is exhausted, the development cartridge may be replaced with a new development cartridge or the development cartridge may be refilled with toner.

BRIEF DESCRIPTION OF THE DRAWINGS

FIG. 5 is a diagram showing equations for an image forming apparatus to estimate a toner remaining rate, according to an example;

FIG. 8 illustrates results data showing that the equations of FIG. 5 for estimating a toner remaining rate are valid when toner refill is performed in a toner exhaustion state in the example of FIG. 7; and FIG. 9 illustrates data showing that the equations of FIG. 5 for estimating a toner remaining rate are valid when toner refill is performed in a state in which toner is not exhausted in the example of FIG. 7.

DETAILED DESCRIPTION

Hereinafter, various examples will be described with reference to accompanying drawings.

Figure 1:
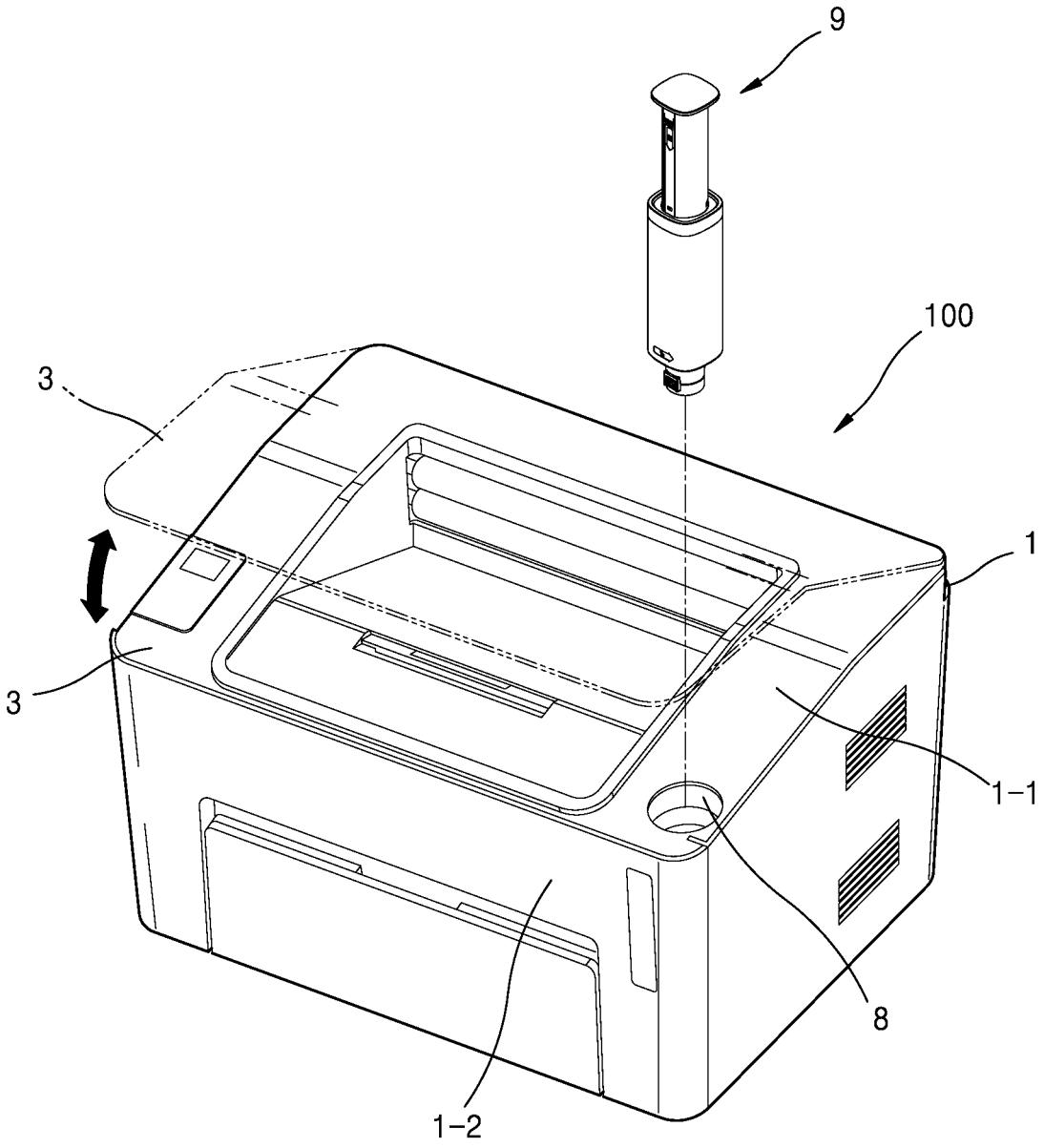
FIG. 1 is a schematic external perspective view of an example of an image forming apparatus in which toner is refilled through combination with a toner refill cartridge.
Figure 2:
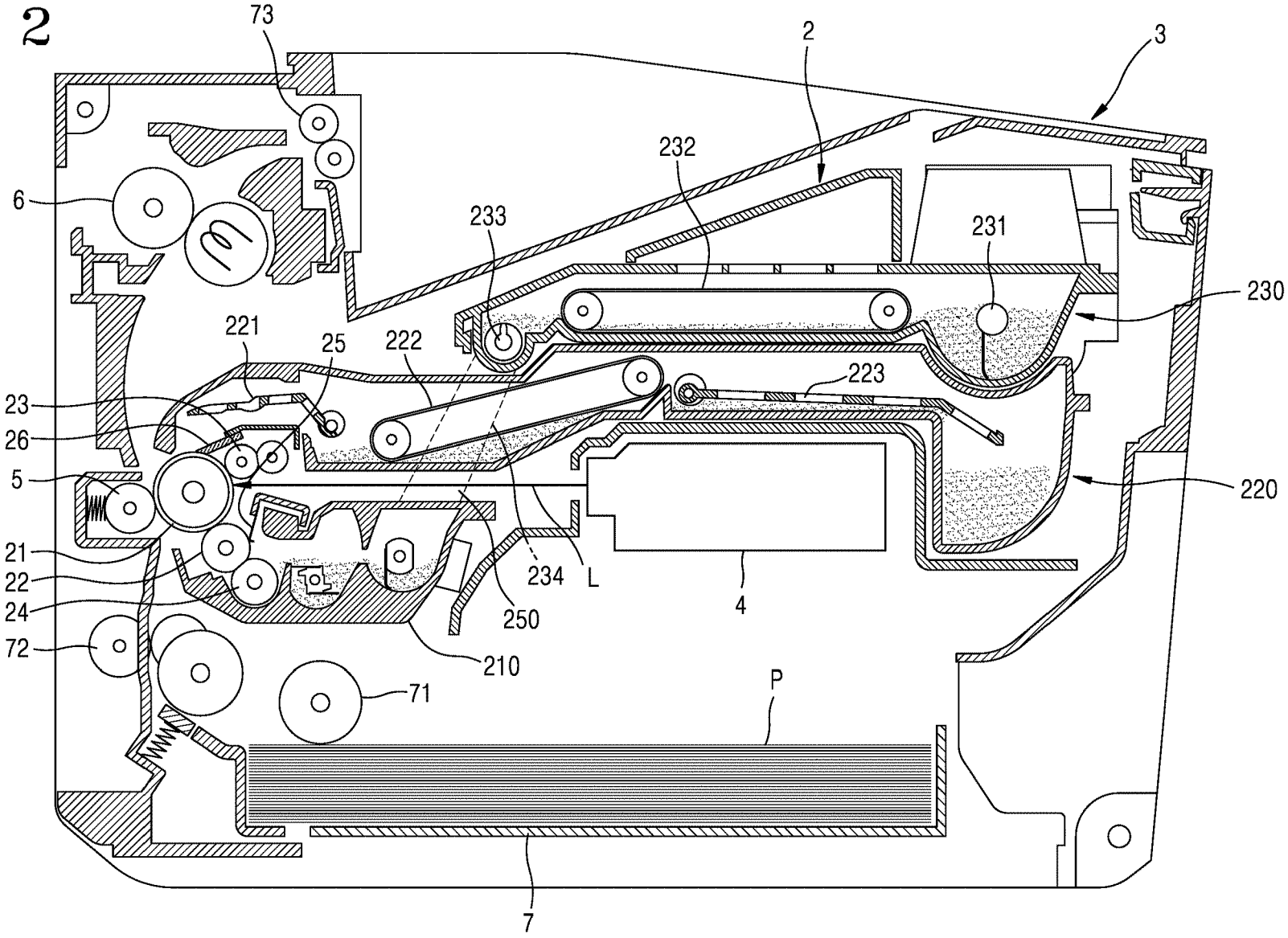
FIG. 2 is a schematic configuration diagram of an example of the image forming apparatus of FIG. 1.
Figure 3:
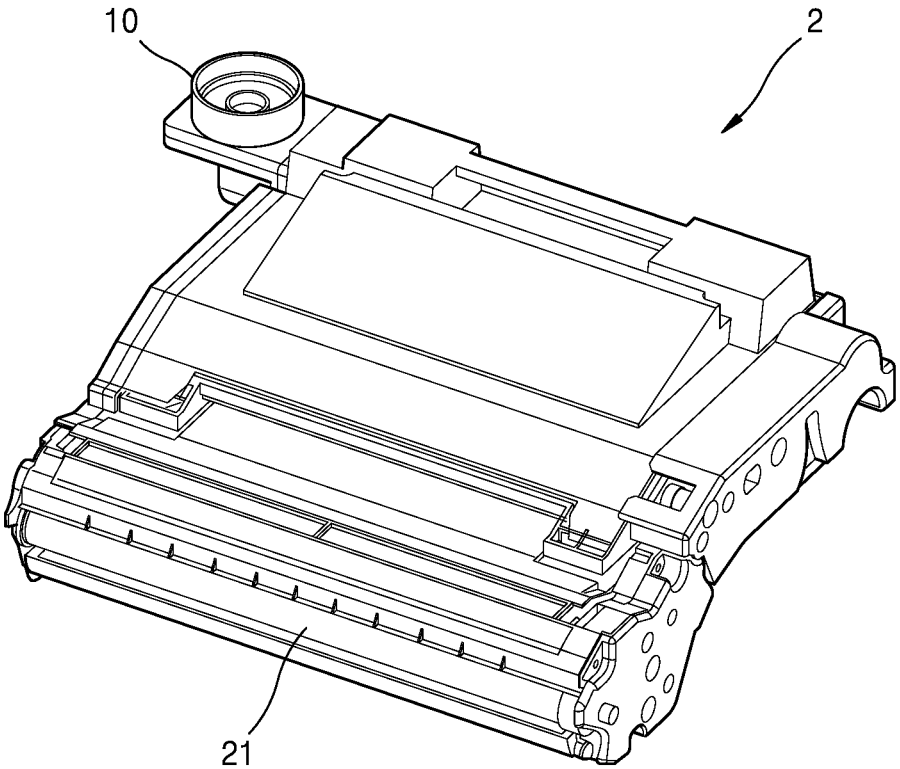
FIG. 3 is a perspective view of an example of a development cartridge that may be employed in the image forming apparatus of FIG. 1.

FIG. 1 is a schematic external perspective view of an example of an image forming apparatus 100 to which toner is refilled by being combined with a toner refill cartridge 9. FIG. 2 is a schematic configuration diagram of an example of the image forming apparatus 100 of FIG. 1. FIG. 3 is a perspective view of an example of a development cartridge 2 that may be employed in the image forming apparatus 100 of FIG. 1.

Referring to FIGS. 1 through 3, the image forming apparatus 100 may include a main body 1 and the development cartridge 2 attachable to and detachable from the main body 1. A door 3 may be provided at the main body 1. The door 3 may open or close a portion of the main body 1. In FIG. 1, the door 3 opening an upper portion of the main body 1 is illustrated, but when required, a door opening a side portion or all of the main body 1 may be employed. A user may open the door 3 to mount or remove the development cartridge 2 on or from the main body 1. A communicating portion 8 may be provided at the main body 1 such that the development cartridge 2 may access a toner refilling portion 10 from the outside of the main body 1 while being mounted on the main body 1. The main body 1 may be mounted with the development cartridge 2 that forms a toner image by supplying toner accommodated in a toner container 230 to an electrostatic latent image formed on a photoconductor. The communicating portion 8 may be provided on an outer surface of the main body 1 to combine the toner refill cartridge 9 for refilling the toner in the toner container 230 by being connected to the toner refilling portion 10 of the development cartridge 2. The communicating portion 8 may be provided at a position close to a front portion 1-2 of the main body 1. Since the front portion 1-2 faces the user, the user may easily access the communicating portion 8. Accordingly, a toner refill job using the toner refill cartridge 9 may be easily performed via the communicating portion 8. The communicating portion 8 may be provided at a top surface 1-1 of the main body 1. The toner refilling portion 10 may be provided below the communicating portion 8. The communicating portion 8 and the toner refilling portion 10 may be aligned in a vertical direction. The toner refill cartridge 9 may access the toner refilling portion 10 through the communicating portion 8 from the above of the main body 1.

A photosensitive drum 21 is an example of a photoconductor on which an electrostatic latent image is formed, and may include a cylindrical metal pipe and a photosensitive layer formed on an outer circumference of the cylindrical metal pipe and having photoconductivity. A charging roller 23 is an example of a charger that charges a surface of the photosensitive drum 21 with uniform electric potential. A charging bias voltage may be applied to the charging roller 23. A corona charger (not shown) may be used instead of the charging roller 23. A developing roller 22 may supply the toner to an electrostatic latent image formed on a surface of the photosensitive drum 21 to develop the electrostatic latent image.

A supply roller 24 may attach the toner to the developing roller 22. A supply bias voltage may be applied to the supply roller 24 to attach the toner to the developing roller 22. A regulating member 25 may regulate an amount of toner attached to the surface of the developing roller 22. The regulating member 25 may be, for example, a regulating blade whose tip contacts the developing roller 22 with certain pressure. A cleaning member 26 may remove residual toner and impurities from the surface of the photosensitive drum 21 before charging. The cleaning member 26 may be, for example, a cleaning blade whose tip contacts the surface of the photosensitive drum 21. Meanwhile, hereinafter, the impurities removed from the surface of the photosensitive drum 21 are referred to as waste toner.

An optical scanner 4 may scan light modulated according to image information on the surface of the photosensitive drum 21 charged with uniform electric potential. As the optical scanner 4, for example, a laser scanning unit (LSU) scanning light emitted from a laser diode on the photosensitive drum 21 by deflecting the light in a main scanning direction by using a polygon mirror may be employed.

A transfer roller 5 is an example of a transfer unit provided to face the photosensitive drum 21 to form a transfer nip. A transfer bias voltage for transferring a toner image developed on the surface of the photosensitive drum 21 onto a print medium P may be applied to the transfer roller 5. A corona transfer unit may be used instead of the transfer roller 5.

The toner image transferred to the surface of the print medium P by the transfer roller 5 may be maintained on the surface of the print medium P via electrostatic attraction. A fuser 6 may apply heat and pressure onto the toner image to fuse the toner image on the print medium P, thereby forming a permanent print image on the print medium P.

The development cartridge 2 according to the current example may include a developing portion 210 where the photosensitive drum 21 and the developing roller 22 are provided, a waste toner container 220 where the waste toner removed from the photosensitive drum 21 is accommodated, and the toner container 230 connected to the developing portion 210 and accommodating the toner. In order to refill the toner in the toner container 230, the development cartridge 2 may include the toner refilling portion 10 connected to the toner container 230. The toner refilling portion 10 provides an interface between the toner refill cartridge 9 and the development cartridge 2 described below. The development cartridge 2 may be an integrated development cartridge including the developing portion 210, the waste toner container 220, the toner container 230, and the toner refilling portion 10.

A portion of an outer circumference of the photosensitive drum 21 may be exposed to an outside of a housing. The transfer roller 5 may contact the exposed portion of the photosensitive drum 21 to form a transfer nip. A conveying member conveying the toner towards the developing roller 22 may be provided at the developing portion 210. The conveying member may also perform a function of filling the toner to certain electric potential by stirring the toner.

The waste toner container 220 may be provided above the developing portion 210. The waste toner container 220 may form a light path 250 by being spaced apart from the developing portion 210 upward. The waste toner removed from the photosensitive drum 21 by the cleaning member 26 may be accommodated in the waste toner container 220. The waste toner removed from the surface of the photosensitive drum 21 may be transported into the waste toner container 220 by a waste toner transport member 221 through 223. A shape and number of waste toner transport members are not specifically limited. The suitable number of waste toner transport members may be provided at suitable positions for effectively distributing the waste toner in the waste toner container 220 in consideration of the volume or shape of the waste toner container 220.

The toner container 230 may accommodate the toner by being connected to the toner refilling portion 10. The toner container 230 may be connected to the developing portion 210 by a toner supply unit 234 as indicated by broken lines in FIG. 2. As shown in FIG. 2, the toner supply unit 234 may be connected to the developing portion 210 by penetrating the waste toner container 220 in a vertical direction. The toner supply unit 234 may be provided outside a valid width of an exposure light L such as not to interfere with the exposure light L scanned in the main scanning direction by the optical scanner 4.

A Toner supply member 231 through 233 for supplying the toner to the developing portion 210 through the toner supply unit 234 may be provided at the toner container 230. A shape and number of toner supply members are not specifically limited. The suitable number of toner supply members may be provided at suitable positions of the toner container 230 to effectively provide the toner to the developing portion 210 in consideration of the volume or shape of the toner container 230. The toner supply member 233 may transfer the toner to the toner supply unit 234.

An image forming operation according to the above configuration will be briefly described. The charging bias voltage may be applied to the charging roller 23 and the photosensitive drum 21 may be charged to uniform electric potential. The optical scanner 4 may scan the light modulated according to the image information on the photosensitive drum 21 to form the electrostatic latent image on the surface of the photosensitive drum 21. The supply roller 24 may attach the toner on the surface of the developing roller 22. The regulating member 25 may form a toner layer of a uniform thickness on the surface of the developing roller 22. The developing bias voltage may be applied to the developing roller 22. The toner transported to the development nip when the developing roller 22 is rotated is moved and attached to the electrostatic latent image formed on the surface of the photosensitive drum 21 by the developing bias voltage, and thus a visible toner image may be formed on the surface of the photosensitive drum 21. The print medium P taken out from the loading tray 7 by a pickup roller 71 may be transported to the transfer nip where the transfer roller 5 and the photosensitive drum 21 face each other, by a feed roller 72. When the transfer bias voltage is applied to the transfer roller 5, the toner image may be transferred to the print medium P by the electrostatic attraction. The toner image transferred to the print medium P may receive heat and pressure from the fuser 6 and may be fused on the print medium P, thereby completing printing. The print medium P is discharged by a discharge roller 73. The toner remaining on the surface of the photosensitive drum 21 without being transferred to the print medium P may be removed by the cleaning member 26.

According to the image forming apparatus 100 of the current example, the development cartridge 2 may include the toner refilling portion 10 such that the toner may be refilled in the development cartridge 2 while the development cartridge 2 is mounted on the main body 1 without detaching the development cartridge 2 from the main body 1. The toner refilling portion 10 may be integrated with the development cartridge 2 to be attached to or detached from the main body 1 together with the development cartridge 2.

Figure 4:
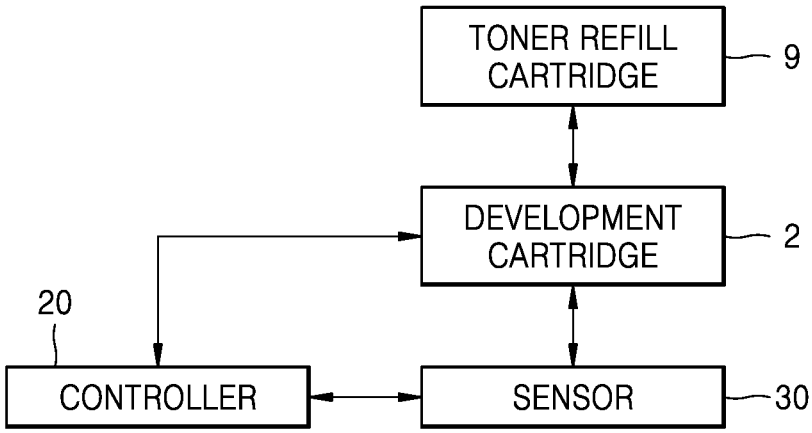
FIG. 4 is a diagram for describing an operation of an image forming apparatus estimating a toner remaining rate, according to an example.

FIG. 4 is a diagram for describing an operation of the image forming apparatus 100 estimating a toner remaining rate, according to an example. FIG. 5 is a diagram showing equations for the image forming apparatus 100 to estimate a toner remaining rate, according to an example.

Referring to FIGS. 4 and 5, a controller 20 of the image forming apparatus 100 may be connected to the development cartridge 2 and a sensor 30 to estimate a toner remaining rate of the development cartridge 2 according to the equations of FIG. 5 for estimating a toner remaining rate.

Referring to Equation ① of FIG. 5 for estimating a toner remaining rate, the estimated toner remaining rate is set to have a value equal to or smaller than 1. When the estimated toner remaining rate is 1, the toner remaining rate is 100%, which denote that the toner is completely filled in the development cartridge 2. In Equation ①, a 'consumption amount' may be calculated by counting pixels or dots, based on image data used in an image forming job. In Equation ①, the 'consumption amount' cumulatively increases the more the user uses the image forming apparatus 100, and a 'consumption amount accumulated at a refill time' is a consumption amount calculated immediately before toner refill, and thus 'consumption amount−consumption amount accumulated at the refill time' after the toner refill has a value of 0. A 'target consumption amount' denotes a consumption amount corresponding to an expected life when the toner is completely filled in the development cartridge 2. A 'correction value' is a value determined according to toner refill capacity after the toner refill, maximum filling capacity of the development cartridge 2, and the toner remaining rate of the development cartridge 2 calculated immediately before the toner refill, for example, based on accumulation, for a calculation, of image data used in performing at least one image forming job until the toner refill. Here, the toner refill capacity after the toner refill may be filling capacity of the toner refill cartridge 9. The maximum filling capacity of the development cartridge 2 or the target consumption amount corresponding to the expected life of the development cartridge 2 may be stored in a memory (not shown) in the development cartridge 2. The filling capacity of the toner refill cartridge 9 or the toner refill capacity corresponding to the expected life of the toner refill cartridge 9 may be stored in a memory (not shown) in the toner refill cartridge 9 and transmitted to the controller 20 via the development cartridge 2.

Referring to Equation ②, the 'correction value' may be a value obtained by subtracting an 'adjusted toner remaining rate based on toner remaining rate calculated immediately before refill' from a ratio of free capacity for further filling the toner despite toner refill capacity to the maximum filling capacity of the development cartridge 2, i.e., a 'free capacity ratio after refill'. The 'adjusted toner remaining rate based on toner remaining rate calculated immediately before refill' indicates adjustment to a suitable value based on whether the 'toner remaining rate calculated immediately before refill' has a negative value because the 'toner remaining rate calculated immediately before refill' may have a negative value. A toner remaining rate calculated immediately before the toner refill may be calculated based on a toner consumption rate obtained by dividing the consumption amount of the toner calculated by counting pixels or dots based on image data used in an image forming job immediately before the toner refill by the consumption amount corresponding to the expected life when the toner is completely filled in the development cartridge 2. Additional descriptions thereof will be provided later with reference to FIGS. 6 through 9. The 'correction value' may indicate that, when the development cartridge 2 is not completely filled because the toner refill capacity is smaller than the maximum filling capacity of the development cartridge 2, the ratio of the free capacity for further filling the toner is subtracted from the toner remaining rate while toner capacity remaining in the development cartridge 2 immediately before the toner refill is added to the toner remaining rate.

Referring to Equation ③, the 'free capacity ratio after refill' is obtained by subtracting the rate of the toner refill capacity after toner refill to the maximum filling capacity of the development cartridge 2, i.e., a 'filling ratio after refill', from 1.

When Equation ① is substituted by Equations ② and ③, Equation ④ for estimating a toner remaining rate may be obtained. In other words, Equation ④ is an equation corresponding to a modified form of Equation ①. Referring to Equation ④, the toner remaining rate of the development cartridge 2 according to the toner refill may be estimated by subtracting a value of term corresponding to the toner consumption rate from a value obtained by adding the toner filling ratio of the development cartridge 2 after toner refill, i.e., the 'filling ratio after refill' and the 'adjusted toner remaining rate based on the toner remaining rate calculated immediately before toner refill'. Since the 'consumption amount−consumption amount accumulated at refill time' after toner refill has a value of 0, the value of term corresponding to the toner consumption rate is 0. Accordingly, the toner remaining rate of the development cartridge 2 according to toner refill may be estimated based on the toner filling ratio of the development cartridge 2 after toner refill and the adjusted toner remaining rate based on the toner remaining rate calculated immediately before toner refill. The toner filling ratio of the development cartridge 2 after toner refill and the adjusted toner remaining rate based on the toner remaining rate calculated immediately before toner refill may be a value determined each time of toner refill and maintained until next toner refill.

Meanwhile, the toner refill may be performed when the toner refill cartridge 9 for refilling the toner by being connected to the development cartridge 2 forming the toner image by supplying the toner to the electrostatic latent image formed on the photoconductor is combined to the development cartridge 2 through the communicating portion 8 formed on the outer surface of the main body 1 where the development cartridge 2 is mounted. According to an example, the toner refill may be performed when the development cartridge 2 is replaced.

Referring back to FIGS. 4 and 5, the controller 20 may estimate the toner remaining rate of the development cartridge 2 according to toner refill, based on the toner filling ratio of the development cartridge 2 after toner refill and the adjusted toner remaining rate based on the toner remaining rate calculated immediately before toner refill, according to a detection result of the sensor 30.

The sensor 30 may detect a remaining toner amount of the development cartridge 2. The sensor 30 may detect whether the remaining toner amount of the development cartridge 2 is smaller or greater than a certain criterion. The sensor 30 may detect whether the remaining toner amount is greater or smaller than the certain criterion or whether there is remaining toner. For example, the sensor 30 may detect the remaining toner amount by detecting the weight of toner accommodated in the development cartridge 2 or detect toner exhaustion by using an optical sensor or the like. The sensor 30 may detect the remaining toner amount of the development cartridge 2 continuously, after a certain period, or when a certain event occurs. Because the sensor 30 may be connected to the development cartridge 2 to detect the remaining toner amount of the development cartridge 2, the sensor 30 may also be used to detect replacement of the development cartridge 2. For example, the controller 20 may determine that the development cartridge 2 is replaced when the sensor 30 detects a change in the weight of toner accommodated in the development cartridge 2 without the toner refill cartridge 9 being combined with the image forming apparatus 100, when the sensor 30 detects that contact of the development cartridge 2 connected to the sensor 30 has been broken, or when the sensor 30 is also replaced together with the development cartridge 2.

The controller 20 may determine whether to preform toner refill and a detailed situation where the toner refill is performed, according to a detection result of the sensor 30. Hereinafter, the estimation of the toner remaining rate of the controller 20 in the detailed situation where the toner refill is performed will be described.

When the development cartridge 2 is replaced by a new development cartridge, the controller 20 may estimate a toner remaining rate of the new development cartridge, based on an initial toner filling ratio of the new development cartridge that is a ratio of actual filled volume of the new development cartridge to maximum filling capacity of the new development cartridge, and the adjusted toner remaining rate having a value of 0.

When the toner is refilled by the toner refill cartridge 9 when the remaining toner amount detected from the sensor 30 is smaller than or equal to a certain criterion, the controller 20 may estimate the toner remaining rate of the development cartridge 2, based on a toner refilling ratio of the development cartridge 2 that is a ratio of actual filled volume of the toner refill cartridge 9 to maximum filling capacity of the development cartridge 2, and the adjusted toner remaining rate having a value of 0. The controller 20 may determine that the toner is exhausted when the remaining toner amount detected from the sensor 30 is smaller than or equal to the certain criterion. Here, the certain criterion is a toner amount corresponding to a certain threshold point at which the toner is assumed to be exhausted, and may be a value set by the user.

When the toner is refilled by the toner refill cartridge 9 when the remaining toner amount detected by the sensor 30 is greater than the certain criterion, the controller 20 may estimate the toner remaining rate of the development cartridge 2, based on the toner refilling ratio of the development cartridge 2 that is the ratio of the actual filled volume of the toner refill cartridge to the maximum filling capacity of the development cartridge 2, and the adjusted toner remaining rate adjusted based on whether the toner remaining rate calculated immediately before toner refill is a negative value. The controller 20 may set the adjusted toner remaining rate to a value of 0 when the toner remaining rate calculated immediately before toner refill is a negative value, and may set the adjusted toner remaining rate to the toner remaining rate calculated immediately before toner refill when the toner remaining rate calculated immediately before toner refill is not a negative value. The controller 20 may determine that the toner is not exhausted when the remaining toner amount detected by the sensor 30 is greater than the certain criterion.

The controller 20 controls overall operations of the image forming apparatus 100 and may include at least one processor, such as a central processing unit (CPU). The controller 20 may control other components included in the image forming apparatus 100.

Meanwhile, the image forming apparatus 100 may display information, such as a state of the image forming apparatus 100, or the like, or receive a user input from the user through a user interface device (not shown). The user interface device may be in a form of a touch screen. For example, the controller 20 may control the user interface device to display, to the user, a result of estimating the toner remaining rate of the development cartridge 2 of the image forming apparatus 100.

Figure 6:
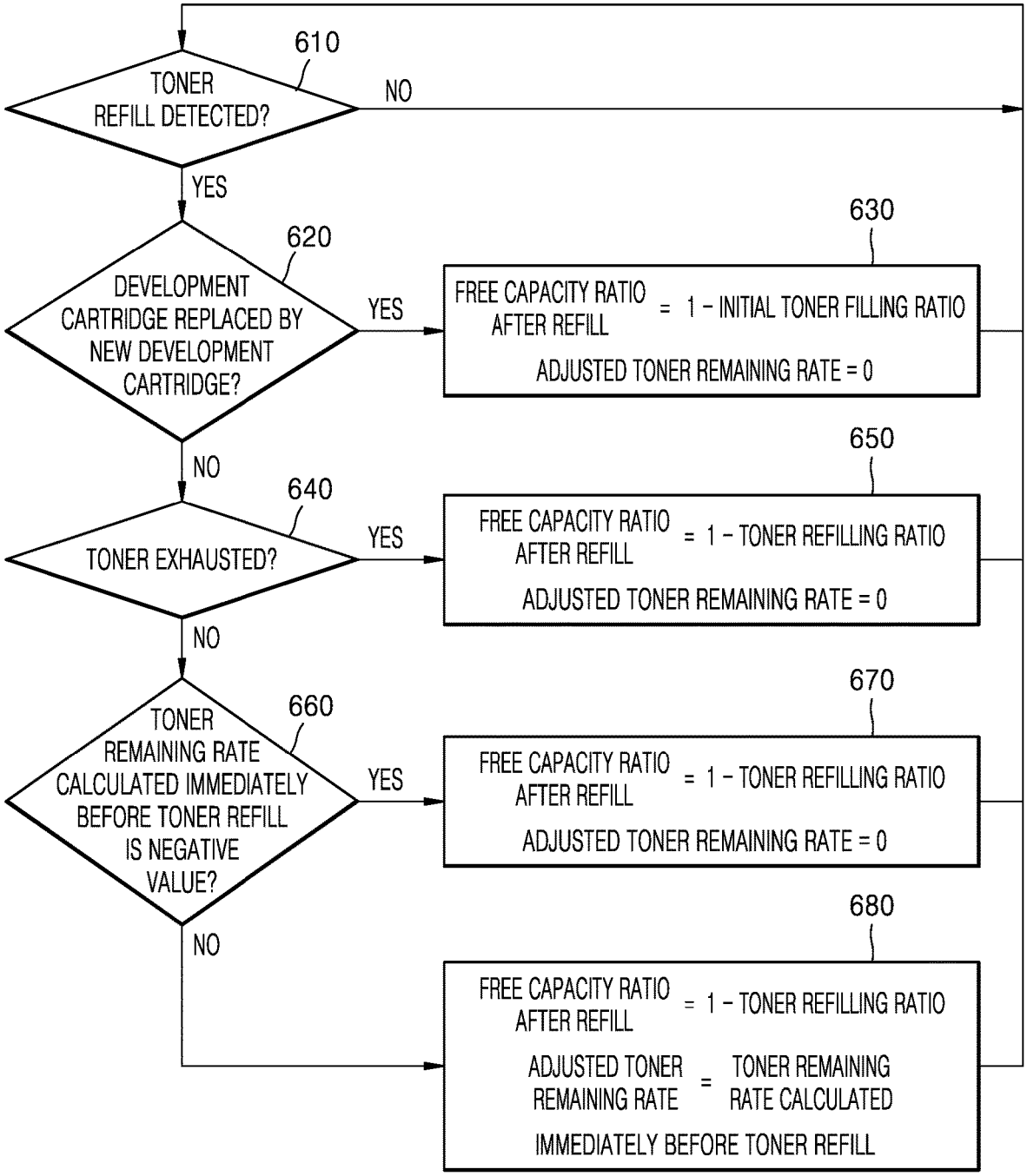
FIG. 6 is a flowchart of a method of estimating a toner remaining rate, according to an example.

FIG. 6 is a flowchart of a method of estimating a toner remaining rate, according to an example.

The image forming apparatus 100 or the controller 20 may detect, by using the sensor 30, the remaining toner amount of the development cartridge 2 mounted on the main body 1 and forming the toner image by supplying the toner to the electrostatic latent image formed on the photoconductor.

The image forming apparatus 100 or the controller 20 may estimate the toner remaining rate of the development cartridge 2 according to toner refill, based on the tonner filling ratio of the development cartridge after toner refill and the adjusted toner remaining rate based on the toner remaining rate calculated immediately before toner refill, according to a detection result of the sensor 30.

Hereinafter, a method by which the image forming apparatus 100 or the controller 20 estimates the toner remaining rate in a detailed situation where toner refill is performed will be described.

In operation 610, the image forming apparatus 100 or controller 20 may detect toner refill. For example, the image forming apparatus 100 or controller 20 may detect that the toner refill is performed when the development cartridge 2 is replaced or when the remaining toner amount of the development cartridge 2 is increased as the toner refill cartridge 9 is combined to the development cartridge 2 through the communicating portion 8 formed on the outer surface of the main body 1 where the development cartridge 2 is mounted.

In operation 620, the image forming apparatus 100 or controller 20 may determine whether the development cartridge 2 is replaced to the new development cartridge.

When the development cartridge 2 is replaced to the new development cartridge, in operation 630, the image forming apparatus 100 or controller 20 may estimate the toner remaining rate of the new development cartridge, based on the initial toner filling ratio of the new development cartridge that is the ratio of the actual filled volume of the new development cartridge to the maximum filling capacity of the new development cartridge, and the adjusted toner remaining rate having a value of 0. Here, the equations of FIG. 5 for estimating a toner remaining rate may be used.

When the development cartridge 2 is not replaced, in operation 640, the image forming apparatus 100 or controller 20 may determine whether the toner of the development cartridge 2 is exhausted. For example, the image forming apparatus 100 or controller 20 may determine whether the toner of the development cartridge 2 is exhausted by determining whether the remaining toner amount of the development cartridge 2 detected by the sensor 30 is greater than the certain criterion.

When the toner of the development cartridge 2 is exhausted, in operation 650, when the toner is refilled by the toner refill cartridge 9, the image forming apparatus 100 or controller 20 may estimate the toner remaining rate of the development cartridge 2, based on the toner refilling ratio of the development cartridge 2 that is the ratio of the actual filled volume of the toner refill cartridge 9 to the maximum filling capacity of the development cartridge 2, and the adjusted toner remaining rate having a value of 0. Here, the equations of FIG. 5 for estimating a toner remaining rate may be used. The image forming apparatus 100 or controller 20 may determine that the toner is exhausted when the remaining toner amount detected by the sensor 30 is smaller than or equal to the certain criterion.

When the development cartridge 2 is not exhausted, in operation 660, the image forming apparatus 100 or controller 20 may determine whether the toner remaining rate calculated immediately before toner refill is a negative value. The image forming apparatus 100 or controller 20 may determine that the toner is not exhausted when the remaining toner amount detected by the sensor is greater than the certain criterion.

When the toner remaining rate calculated immediately before toner refill is a negative value, in operation 670, when the toner is refilled by the toner refill cartridge 9, the image forming apparatus 100 or controller 20 may estimate the toner remaining rate of the development cartridge 2, based on the toner refilling ratio of the development cartridge 2 that is the ratio of the actual filled volume of the toner refill cartridge to the maximum filling capacity of the development cartridge 2, and the adjusted toner remaining rate having a value of 0. Here, the equations of FIG. 5 for estimating a toner remaining rate may be used.

When the toner remaining rate calculated immediately before toner refill is not a negative value, in operation 680, when the toner is refilled by the toner refill cartridge 9, the image forming apparatus 100 or controller 20 may estimate the toner remaining rate of the development cartridge 2, based on the toner refilling ratio of the development cartridge 2 that is the ratio of the actual filled volume of the toner refill cartridge 9 to the maximum filling capacity of the development cartridge 2, and the adjusted toner remaining rate having a value of the toner remaining rate calculated immediately before toner refill. Here, the equations of FIG. 5 for estimating a toner remaining rate may be used.

Figure 7:
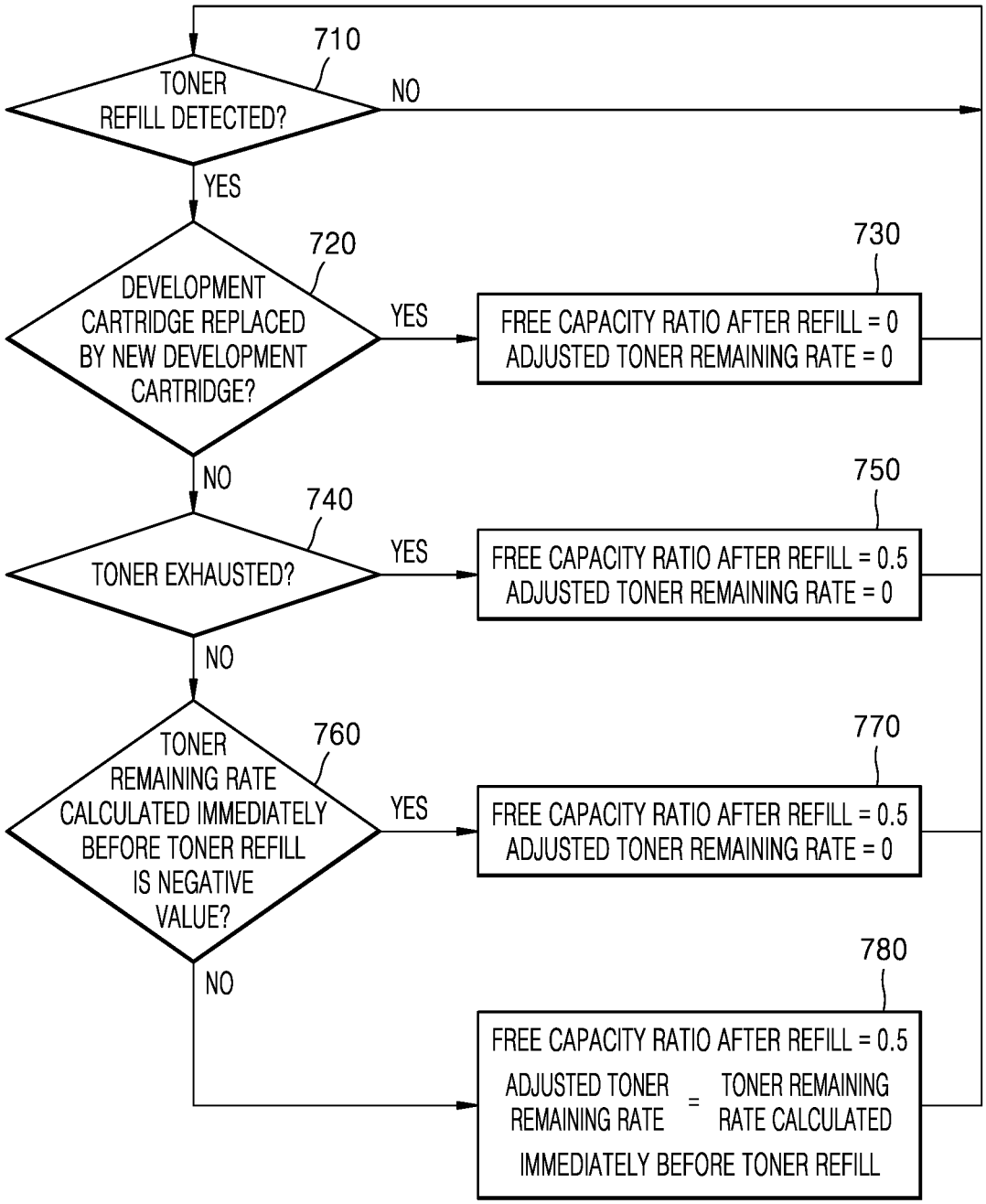
FIG. 7 is a flowchart for describing a method of estimating a toner remaining rate, according to an example, with an example.

FIG. 7 is a flowchart for describing a method of estimating a toner remaining method, according to an example, with an example. Details that overlap those of FIG. 6 will not be provided again.

In FIG. 7, a case where the development cartridge 2 is replaced is described with an example in which the actual filled volume of the new development cartridge is equal to the maximum filling capacity of the new development cartridge, i.e., the actual filled volume of the new development cartridge is 100%.

A case of toner refill using the toner refill cartridge 9 is described with an example in which the ratio of the actual filled volume of the toner refill cartridge 9 to the maximum filling capacity of the development cartridge 2 is 0.5, and 50% of the development cartridge 2 is refilled by using the toner refill cartridge 9.

According to such an example, when the development cartridge 2 is replaced to the new development cartridge in operation 720, in operation 730, since the initial toner filling ratio of the new development cartridge is 1, the image forming apparatus 100 or controller 20 sets the 'free capacity ratio after refill' to 0 and the 'adjusted toner remaining rate' to 0. When each numerical value substitutes for the equations of FIG. 5 for estimating a toner remaining rate, the 'correction value' becomes 0 and the 'consumption amount−consumption amount accumulated at refill time' after toner refill has a value of 0 according to Equation ②, and thus the 'estimated toner remaining rate' becomes 1 according to Equation ①. Since the actual filled volume of the new development cartridge is 100%, the 'estimated toner remaining rate' is identified to be 1 corresponding to 100%.

When the toner of the development cartridge 2 is exhausted in operation 740, in operation 750, since the toner refilling ratio of the development cartridge 2 refilled by the toner refill cartridge 9 is 0.5, the image forming apparatus 100 or controller 20 sets the 'free capacity ratio after refill' to 0.5 and the 'adjusted toner remaining rate' to 0. When each numerical value substitutes for the equations of FIG. 5 for estimating a toner remaining rate, the 'correction value' becomes 0.5 and the 'consumption amount−consumption amount accumulated at refill time' after toner refill has a value of 0 according to Equation ②, and thus the 'estimated toner remaining rate' becomes 0.5 according to Equation ①. Since 50% of the development cartridge 2 is refilled by the toner refill cartridge 9, the 'estimated toner remaining rate' is identified to be 0.5 corresponding to 50%.

When the toner of the development cartridge 2 is not exhausted and the toner remaining rate calculated immediately before toner refill is a negative value in operation 760, in operation 770, since the toner refilling ratio of the development cartridge 2 refilled by the toner refill cartridge 9 is 0.5, the image forming apparatus 100 or controller 20 may set the 'free capacity ratio after refill' to 0.5 and the 'adjusted toner remaining rate' to 0. When each numerical value substitutes for the equations of FIG. 5 for estimating a toner remaining rate, the 'correction value' becomes 0.5 and the 'consumption amount−consumption amount accumulated at refill time' after toner refill has a value of 0 according to Equation ②, and thus the 'estimated toner remaining rate' becomes 0.5 according to Equation ①. Since 50% of the development cartridge 2 is refilled by the toner refill cartridge 9, the 'estimated toner remaining rate' is identified to be 0.5 corresponding to 50%. In other words, when the toner remaining rate calculated immediately before toner refill is a negative value despite the toner is not exhausted, the 'adjusted toner remaining rate' is set to be 0 such that the 'estimated toner remaining rate' that is the toner refilling ratio of the development cartridge 2 does not decrease down to less than 0.5.

When the toner of the development cartridge 2 is not exhausted and the toner remaining rate calculated immediately before toner refill is not a negative value, in operation 780, since the toner refilling ratio of the development cartridge 2 refilled by the toner refill cartridge 9 is 0.5, the image forming apparatus 100 or controller 20 sets the 'free capacity ratio after refill' to 0.5 and the 'adjusted toner remaining rate' to the toner remaining rate calculated immediately before toner refill. When each numerical value substitutes for the equations of FIG. 5 for estimating a toner remaining rate, the 'correction value' becomes '0.5−toner remaining rate calculated immediately before toner refill' and the 'consumption amount−consumption amount accumulated at refill time' after toner refill has a value of 0 according to Equation ②, and thus the 'estimated toner remaining rate' becomes '0.5+toner remaining rate calculated immediately before toner refill' according to Equation ①. In other words, when the toner is not exhausted and the toner remaining rate calculated immediately before toner refill is not a negative value, the 'adjusted toner remaining rate' is set to the toner remaining rate calculated immediately before the toner refill such that the toner remaining rate equal to the toner capacity left in the development cartridge 2 immediately before toner refill is further reflected to the 'estimated toner remaining rate'.

FIG. 8 illustrates data results showing that the equations of FIG. 5 for estimating a toner remaining rate are valid when toner refill is performed in a toner exhaustion state in the example of FIG. 7.

Referring to FIG. 8, Case 1 denotes a case in which the toner remaining rate calculated immediately before toner refill and the actual toner remaining rate are the same and are 0, Case 2 denotes a case in which the toner remaining rate calculated immediately before toner refill is greater than the actual toner remaining rate and thus is greater than 0, and Case 3 denotes a case in which the toner remaining rate calculated immediately before toner refill is smaller than the actual toner remaining rate and thus is smaller than 0.

Since the toner refill is performed in the toner exhaustion state in FIG. 8, it is appropriate that the toner remaining rate calculated immediately before toner refill is adjusted to have a value of 0. Since the development cartridge 2 is refilled to 50% by using the toner refill cartridge 9 while the toner is exhausted in terms of the user who refilled the toner in the image forming apparatus 100, the user may expect the estimated toner remaining rate to be 50% corresponding to a value of 0.5.

Referring to the data results of FIG. 8, in all cases, the actual toner remaining rates are 0 immediately before toner refill, the toner remaining rates calculated immediately before toner refill are all adjusted to 0 regardless of values thereof, and the 'consumption amount−consumption amount accumulated at refill time' after refill is 0, and thus the estimated toner remaining rate is 50% corresponding to a value of 0.5.

FIG. 9 illustrates results data showing that the equations of FIG. 5 for estimating a toner remaining rate are valid when toner refill is performed in a state in which toner is not exhausted in the example of FIG. 7.

Referring to FIG. 9, Case 1 denotes a case in which the toner remaining rate calculated immediately before toner refill and the actual toner remaining rate are the same and are greater than 0, Case 2 denotes a case in which the toner remaining rate calculated immediately before toner refill is greater than the actual toner remaining rate, and Case 3 denotes a case in which the toner remaining rate calculated immediately before toner refill is smaller than the actual toner remaining rate and thus is smaller than 0.

Since the toner refill is performed not in the toner exhaustion state in FIG. 9, it is determined that the actual toner remaining rate immediately before toner refill is greater than 0. Since 50% of the development cartridge 2 is further refilled by using the toner refill cartridge 9 before the toner is exhausted in terms of the user who refilled the toner in the image forming apparatus 100, the user may expect the estimated toner remaining rate to be at least 50% corresponding to a value of at least 0.5.

Referring to the data results of FIG. 9, in all cases, the actual toner remaining rates immediately before toner refill are greater than 0 and the 'consumption amount−consumption amount accumulated at refill time' after refill time is 0. In Case 3 in which the toner remaining rate calculated immediately before toner refill is a negative value corresponding to −10%, the toner remaining rate calculated immediately before toner refill is adjusted to 0, and in Cases 1 and 2 in which the toner remaining rate calculated immediately before toner refill is not a negative value, the toner remaining rate calculated immediately before toner refill may be the adjusted toner remaining rate. In Cases 1 and 2, the estimated toner remaining rate is 70% (50%+20%), and in Case 3, the estimated toner remaining rate is 50%. In all cases, the estimated toner remaining rate after toner refill is at least 50% corresponding to a value of at least 0.5.

Meanwhile, examples described above may be associated with computer-readable recording medium storing computer- or processor-executable instructions or data. The examples may be written as computer-executable programs and may be implemented in general-use digital computers that execute the programs using the computer-readable recording medium. Examples of the computer-readable recording medium include read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, magnetic tape, a floppy disk, a magneto-optical data storage device, an optical data storage device, a hard disk, a solid-state disk (SSD), and any device capable of storing instructions or machine readable instructions, related data, a data file, and data structures and providing the instructions or machine readable instructions, the related data, the data file, and the data structures to a processor or a computer such that the processor or the computer may execute the instructions.

What is claimed is:

1. An image forming apparatus comprising:

a body on which a development cartridge is mountable to form a toner image by supplying toner in the development cartridge to an electrostatic latent image formed;

a communicating portion provided on an outer surface of the body to be coupled with a toner refill cartridge to form a connection with the development cartridge to perform a toner refill of the toner in the development cartridge through the connection with the development cartridge;

a sensor to detect a remaining toner amount remaining in the development cartridge; and a controller to estimate, based on the sensor detecting the remaining toner amount, an estimated toner remaining rate of the development cartridge, which is an estimated rate of the toner remaining in the development cartridge based on toner consumption, according to the toner refill, based on a toner filling ratio of the development cartridge, which is a ratio of a volume of the toner of the development cartridge after the toner refill to a toner filling capacity of the development cartridge, and an adjusted toner remaining rate that is an adjusted value of a toner remaining rate calculated based on image data used in performing of at least one image forming job until the toner refill.

2. The image forming apparatus of claim 1, wherein the controller is to, when the remaining toner amount detected by the sensor is greater than a criterion and the toner is refilled by the toner refill cartridge, estimate the estimated toner remaining rate of the development cartridge, based on a toner refilling ratio of the development cartridge that is a ratio of the volume of the toner refill cartridge to the toner filling capacity of the development cartridge, and the adjusted toner remaining rate adjusted based on whether the toner remaining rate calculated based on the image data used in the performing of the at least one image forming job until the toner refill is a negative value.

3. The image forming apparatus of claim 2, wherein the controller is to set the adjusted toner remaining rate to a value of 0 when the toner remaining rate calculated based on the image data used in the performing of the at least one image forming job until the toner refill is a negative value, and to set the adjusted toner remaining rate to the toner remaining rate calculated based on the image data used in the performing of the at least one image forming job until the toner refill when the toner remaining rate calculated based on the image data used in the performing of the at least one image forming job until the toner refill is not a negative value.

4. The image forming apparatus of claim 1, wherein the controller is to, when the remaining toner amount detected by the sensor is smaller than or equal to a criterion and the toner is refilled by the toner refill cartridge, estimate the estimated toner remaining rate of the development cartridge, based on a toner refilling ratio of the development cartridge that is a ratio of the volume of the toner refill cartridge to the toner filling capacity of the development cartridge, and the adjusted toner remaining rate having a value of 0.

5. The image forming apparatus of claim 1, wherein the controller is to, when the development cartridge is replaced by a new development cartridge, estimate a new toner remaining rate of the new development cartridge, based on an initial toner filling ratio of the new development cartridge that is a ratio of the volume of the new development cartridge to the toner filling capacity of the new development cartridge, and the adjusted toner remaining rate having a value of 0.

6. The image forming apparatus of claim 1, wherein the toner filling ratio after the toner refill and the adjusted toner remaining rate of the development cartridge are determined in response to the toner refill and are maintained until a next toner refill.

7. The image forming apparatus of claim 1, wherein the toner remaining rate is calculated based on a toner consumption rate obtained by dividing, a consumption amount of the toner calculated by counting pixels or dots based on the image data used in the performing the at least one image forming job until the toner refill, by a consumption amount corresponding to an expected life when the development cartridge is completely filled with the toner.

8. A method of estimating a toner remaining rate of a development cartridge, the method comprising:

detecting, by a sensor, a remaining toner amount of a development cartridge mounted on a body of an image forming apparatus to form a toner image by supplying toner in the development cartridge to an electrostatic latent image formed; and estimating, based on the detecting the remaining toner amount by the sensor, an estimated toner remaining rate of the development cartridge, which is an estimated rate of the toner remaining in the development cartridge based on toner consumption, according to a toner refill of the toner in the development cartridge, based on a toner filling ratio of the development cartridge, which is a ratio of a volume of the toner of the development cartridge after the toner refill to a toner filling capacity of the development cartridge, and an adjusted toner remaining rate that is an adjusted value of a toner remaining rate calculated based on image data used in performing of at least one image forming job until the toner refill.

9. The method of claim 8, further comprising coupling a toner refill cartridge with the development cartridge through a communicating portion provided on an outer surface of the body, wherein the toner refill cartridge is to form a connection with the development cartridge to perform the toner refill of the toner in the development cartridge through the connection with the development cartridge, wherein the estimating the estimated toner remaining rate comprises, when the remaining toner amount detected by the sensor is greater than a criterion and the toner is refilled by the toner refill cartridge, estimating the estimated toner remaining rate of the development cartridge, based on a toner refilling ratio of the development cartridge that is a ratio of the volume of the toner refill cartridge to the toner filling capacity of the development cartridge, and the adjusted toner remaining rate adjusted based on whether the toner remaining rate calculated based on the image data used in the performing of the at least one image forming job until the toner refill is a negative value.

10. The method of claim 9, wherein the estimating further comprises setting the adjusted toner remaining rate to a value of 0 when the toner remaining rate calculated based on the image data used in the performing of the at least one image forming job until the toner refill is a negative value, and setting the adjusted toner remaining rate to the toner remaining rate calculated based on the image data used in the performing of the at least one image forming job until the toner refill when the toner remaining rate calculated based on the image data used in the performing of the at least one image forming job until the toner refill is not a negative value.

11. The method of claim 8, further comprising coupling a toner refill cartridge with the development cartridge through a communicating portion provided on an outer surface of the body, wherein the toner refill cartridge is to form a connection with the development cartridge to perform the toner refill of the toner in the development cartridge through the connection with the development cartridge, wherein the estimating the estimated toner remaining rate comprises, when the remaining toner amount detected by the sensor is smaller than or equal to a criterion and the toner is refilled by the toner refill cartridge, estimating the estimated toner remaining rate of the development cartridge, based on a toner refilling ratio of the development cartridge that is a ratio of the volume of the toner refill cartridge to the toner filling capacity of the development cartridge, and the adjusted toner remaining rate having a value of 0.

12. The method of claim 8, wherein the estimating comprises, when the development cartridge is replaced by a new development cartridge, estimating a new toner remaining rate of the new development cartridge, based on an initial toner filling ratio of the new development cartridge that is a ratio of the volume of the new development cartridge to the toner filling capacity of the new development cartridge, and the adjusted toner remaining rate having a value of 0.

13. The method of claim 8, wherein the toner filling ratio after the toner refill and the adjusted toner remaining rate of the development cartridge are determined at in response to the toner refill and are maintained until a next toner refill.

14. The method of claim 8, wherein the toner remaining rate is calculated based on a toner consumption rate obtained by dividing, a consumption amount of the toner calculated by counting pixels or dots based on the image data used in the performing the at least one image forming job until the toner refill, by a consumption amount corresponding to an expected life when the development cartridge is completely filled with the toner.

15. A computer-readable non-transitory recording medium storing instructions executable by a processor, the computer-readable non-transitory recording medium comprising:

instructions to detect, by a sensor, a remaining toner amount of a development cartridge mounted on a body of an image forming apparatus, to form a toner image by supplying toner in the development cartridge to an electrostatic latent image; and instructions to estimate, based on the remaining toner amount detected by the sensor, an estimated toner remaining rate of the development cartridge, which is an estimated rate of the toner remaining in the development cartridge based on toner consumption, according to a toner refill of the toner in the cartridge, based on a toner filling ratio of the development cartridge, which is a ratio of a volume of the toner of the development cartridge after the toner refill to a toner filling capacity of the development cartridge, and an adjusted toner remaining rate that is an adjusted value of a toner remaining rate calculated based on image data used in performing of at least one image forming job until the toner refill.

* * * * *